US010527385B1

(12) United States Patent
Schumacher

(10) Patent No.: US 10,527,385 B1
(45) Date of Patent: Jan. 7, 2020

(54) RAPIDLY ADJUSTABLE RECEIVER EXTENSION

(71) Applicant: Theodore R. Schumacher, Deerfield, WI (US)

(72) Inventor: Theodore R. Schumacher, Deerfield, WI (US)

( * ) Notice: Subject to any disclaimer, the term of this patent is extended or adjusted under 35 U.S.C. 154(b) by 0 days.

(21) Appl. No.: 16/196,446

(22) Filed: Nov. 20, 2018

Related U.S. Application Data

(60) Provisional application No. 62/595,715, filed on Dec. 7, 2017.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14
USPC ..... 42/73
See application file for complete search history.

(56) References Cited

U.S. PATENT DOCUMENTS 3,137,958 A 6/1964 Lewis et al.
7,793,453 B1 * 9/2010 Sewell, Jr. ..... F41C 23/14 42/73
9,612,083 B2 4/2017 Cottle et al.
2003/0101631 A1 * 6/2003 Fitzpatrick ..... F41C 23/04 42/72
2010/0205846 A1 * 8/2010 Fitzpatrick ..... F41A 11/02 42/73
2012/0180353 A1 * 7/2012 Holmberg ..... F41A 3/84 42/1.06
2014/0259848 A1 * 9/2014 Chvala ..... F41C 23/14 42/73
2015/0176944 A1 * 6/2015 Kupanoff ..... F41C 23/14 42/73
2016/0327361 A1 * 11/2016 Roberts ..... F41C 23/14
2017/0356718 A1 * 12/2017 Johnson ..... F41C 23/20
2018/0003459 A1 * 1/2018 Miller ..... F41C 23/04
2018/0120055 A1 * 5/2018 Silverman ..... F41C 23/14
2018/0347939 A1 * 12/2018 Keller ..... F41C 23/14
2019/0017774 A1 * 1/2019 Vanek ..... F41C 23/04

* cited by examiner

*Primary Examiner* — Bret Hayes
(74) *Attorney, Agent, or Firm* — Donald J. Ersler

(57) ABSTRACT

A rapidly adjustable receiver extension preferably includes a modified receiver extension and a ramped indexing plate. The modified receiver extension includes an indexing slot machined in a standard receiver extension to receive the ramped indexing plate. The ramped indexing plate is retained in the indexing slot with any suitable retention method. The ramped indexing plate preferably includes a plurality of inclined surfaces with a flat indexing slot disposed between two adjacent inclined surfaces. A length of the flat indexing slot is slightly longer than a diameter of a locking pin. A threaded tap is formed in each inclined surface for receiving a set screw or the like as a stop. One end of the rapidly adjustable receiver extension is attached to a rifle and an opposing end of the modified receiver extension is retained in a butt stock.

10 Claims, 4 Drawing Sheets

RAPIDLY ADJUSTABLE RECEIVER EXTENSION

CROSS-REFERENCES TO RELATED APPLICATIONS

This is a non-provisional patent application, which claims the benefit of provisional application No. 62/595,715, filed on Dec. 7, 2017.

BACKGROUND OF THE INVENTION

Field of the Invention

The present invention relates generally to firearms and more specifically to a rapidly adjustable receiver extension, which allows a desired butt stock length to be pre-set.

Discussion of the Prior Art

U.S. Pat. No. 3,137,958 to Lewis et al. discloses an adjustable butt stock. U.S. Pat. No. 9,612,083 to Cottle et al. discloses an adjustable length slide-action rifle stock. However, Lewis and Cottle et al. do not teach or suggest a rapidly adjustable receiver extension, which allows a desired butt stock length to be pre-set and to be quickly extended from a retracted butt stock length to the desired butt stock length by pulling the butt stock.

Accordingly, there is a clearly felt need in the art for a rapidly adjustable receiver extension, which allows a desired butt stock length to be pre-set and to be quickly extended from a retracted butt stock length to the desired butt stock length by pulling the butt stock.

SUMMARY OF THE INVENTION

The present invention provides a rapidly adjustable receiver extension, which allows a desired butt stock length to be pre-set. The rapidly adjustable receiver extension preferably includes a modified receiver extension and a ramped indexing plate. The modified receiver extension includes an indexing plate slot machined in a standard receiver extension to receive the ramped indexing plate. The ramped indexing plate is retained in the indexing slot with any suitable retention method. The ramped indexing plate preferably includes a plurality of inclined surfaces with a flat indexing slot disposed between two adjacent inclined surfaces. A length of the flat indexing slot is slightly longer than a diameter of a locking pin. A threaded tap is preferably formed in each inclined surface for receiving a threaded stud or the like as a stop. One end of the rapidly adjustable receiver extension is attached to a rifle and an opposing end of the modified receiver extension is retained in the butt stock. A release lever of the butt stock is pulled downward to remove the locking pin from the flat indexing slot, when decreasing a length of the rifle. However, when increasing a length of the rifle, the butt stock is pulled backwards, until the locking pin hits a stop fastener in one of the threaded taps in the ramped indexing plate.

Accordingly, it is an object of the present invention to provide a rapidly adjustable receiver extension, which allows a desired butt stock length to be pre-set and to be quickly extended from a retracted butt stock length to the desired butt stock length by pulling the butt stock.

These and additional objects, advantages, features and benefits of the present invention will become apparent from the following specification.

DETAILED DESCRIPTION OF THE PREFERRED EMBODIMENTS

Figure 1:
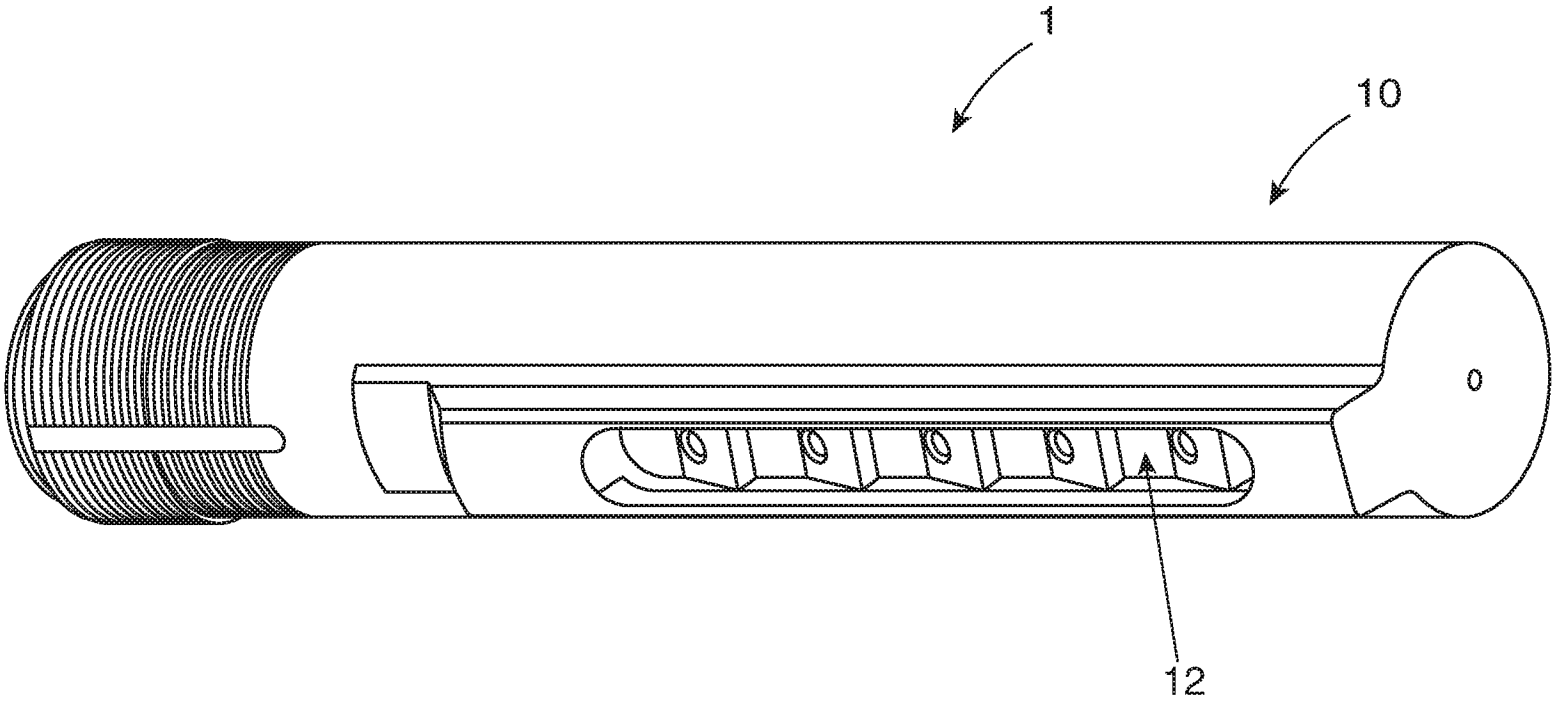
FIG. 1 is a perspective view of a rapidly adjustable receiver extension in accordance with the present invention.
Figure 2:
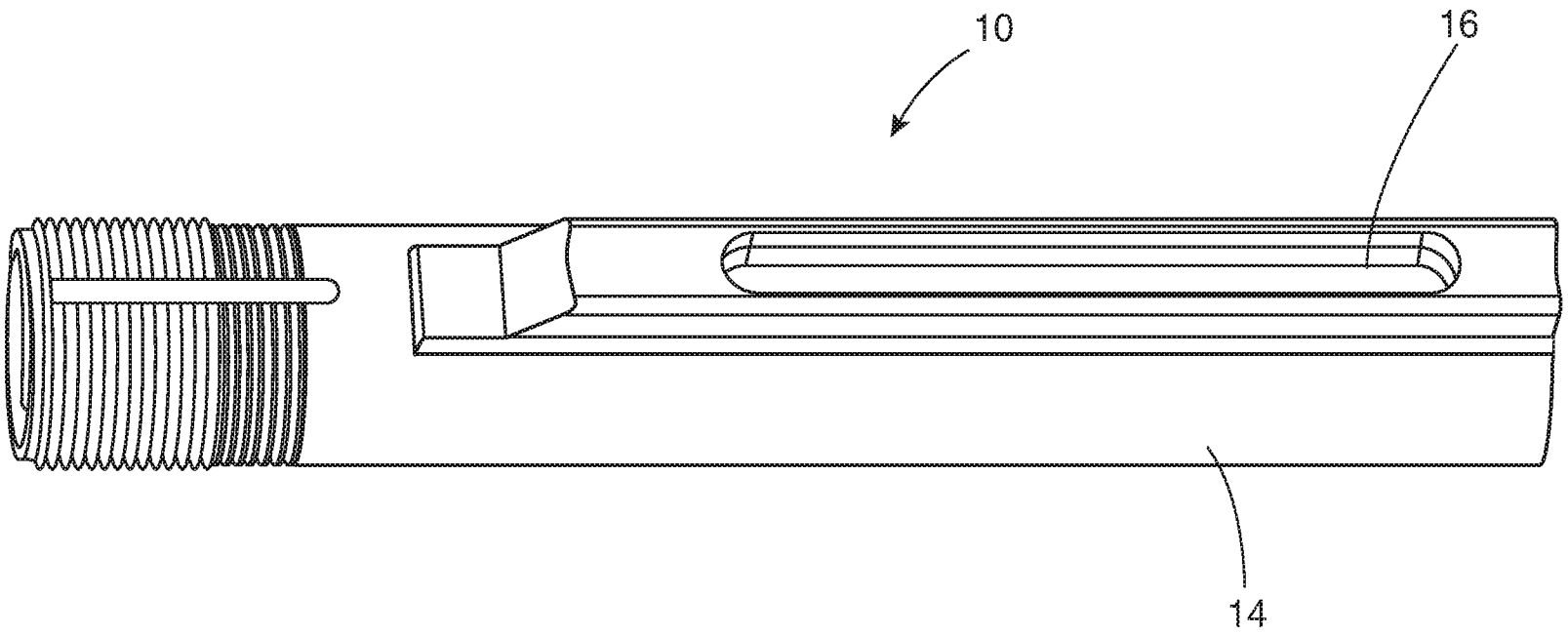
FIG. 2 is a perspective view of a modified receiver extension, before insertion of a ramped index plate of a rapidly adjustable receiver extension in accordance with the present invention.
Figure 3:
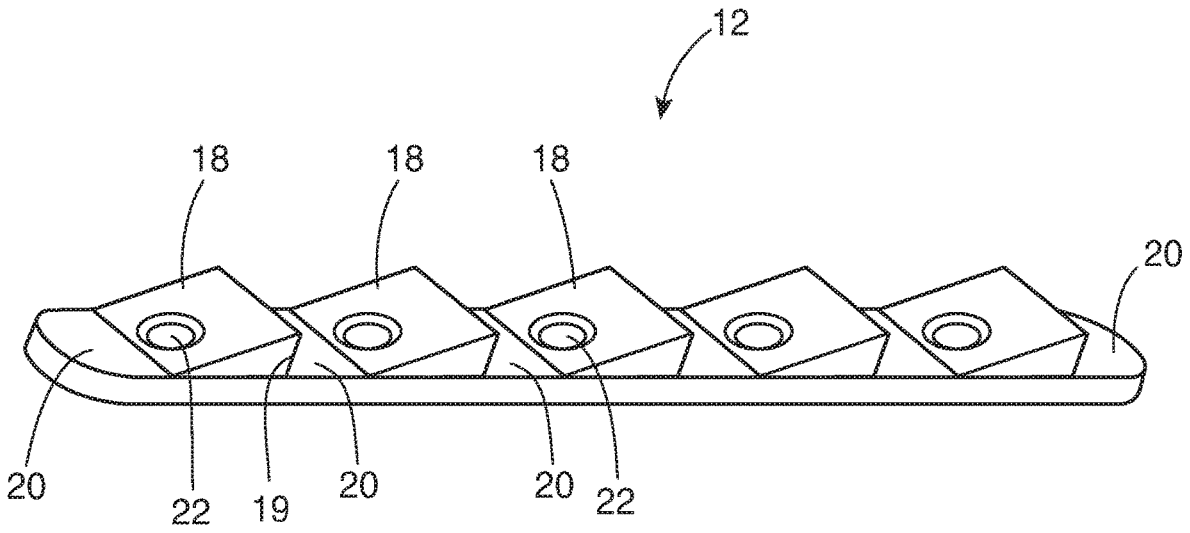
FIG. 3 is a perspective view of a ramped index plate of a rapidly adjustable receiver extension in accordance with the present invention.
Figure 4:
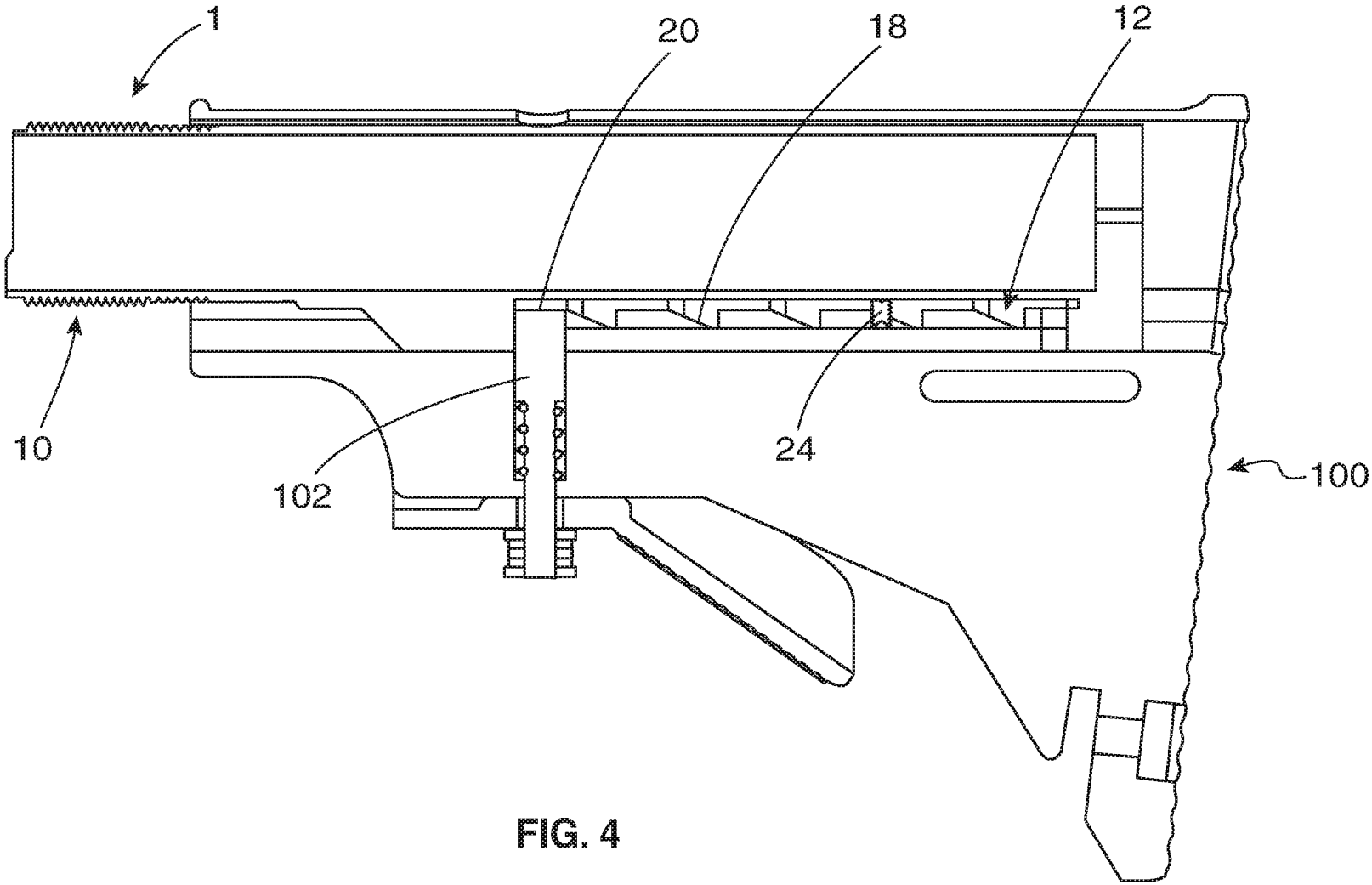
FIG. 4 is a cross sectional view of a rapidly adjustable receiver extension retained in a butt stock in a retracted position in accordance with the present invention.

With reference now to the drawings, and particularly to FIG. 3, there is shown a perspective view of a rapidly adjustable receiver extension 1. With reference to FIGS. 2-3, the rapidly adjustable receiver extension 1 preferably includes a modified receiver extension 10 and a ramped indexing plate 12. The modified receiver extension 10 includes an indexing plate slot 16 machined in a standard receiver extension 14 to receive the ramped indexing plate 12. The indexing plate slot 16 is formed in an area where indexing slots are normally formed. The ramped indexing plate 12 is retained in the indexing plate slot 16 with any suitable retention method. The ramped indexing plate 12 preferably includes a plurality of inclined surfaces with a flat indexing slot 20 disposed between two adjacent inclined surfaces 18. Each inclined surface 18 includes a vertical wall 19, which extends downward from a top of the inclined surface 18 to the flat indexing slot 20. With reference to FIG. 4, a length of the flat indexing slot 20 is slightly longer than a diameter of a locking pin 102 of a butt stock 100. A threaded tap 22 is formed in each inclined surface 18 for receiving a set screw 24, a threaded stud or the like as a stop. A lengthwise axis of the threaded tap 22 is substantially perpendicular to the flat indexing slot 20. The threaded tap 22 is formed adjacent to the flat indexing slot 20. However, the threaded tap 22 could be a hole. A roll pin, a dowel pin or any other suitable object may be inserted into the hole to act as the stop. The ramped indexing plate 12 preferably also includes flat indexing slots 20 extending from front and rear ends thereof. The flat indexing slots 20 may be used to retain the ramped indexing plate 12 in the indexing plate slot 16 with fasteners or the like.

However, the rapidly adjustable receiver extension 1 may also be fabricated as a single piece of material by machining the plurality of inclined surfaces 18, the plurality of flat indexing slots 20 and the plurality of threaded taps 22 into a receiver extension blank where prior art indexing slots are normally formed.

One end of the rapidly adjustable receiver extension 1 is attached to a rifle (not shown) and an opposing end of the rapidly adjustable receiver extension 1 is retained in the butt stock 100. A release lever 104 of the butt stock 100 is pulled downward to remove the locking pin 102 from the flat indexing slot 20, when decreasing an overall length of the rifle. An end of the locking pin 102, which contacts the indexing plate slot 16 is substantially perpendicular to a lengthwise axis of the locking pin 102. However, when increasing a length of the rifle, the butt stock 100 is pulled backwards, until the locking pin 102 hits a stop fastener 24 in one of the threaded taps 22 in the ramped indexing plate 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A rapidly adjustable receiver extension, comprising:

a ramped indexing plate including a plurality of inclined surfaces with an indexing slot disposed adjacent each one of said plurality of inclined surfaces, a vertical wall extends downward from a top of each one of said plurality of inclined surfaces to said indexing slot; and a receiver extension having an indexing plate slot formed therein to receive said ramped indexing plate, wherein said receiver extension is capable of being retained in a butt stock.

2. The rapidly adjustable receiver extension of claim 1 wherein:

a threaded tap or a hole is formed in at least one of said plurality of inclined surfaces to receive a threaded fastener or an object.

3. The rapidly adjustable receiver extension of claim 2 wherein:

said threaded tap or said hole is formed adjacent to said indexing slot.

4. The rapidly adjustable receiver extension of claim 1 wherein:

said indexing slot is longer than a diameter of an indexing pin.

5. The rapidly adjustable receiver extension of claim 1 wherein:

an end surface of a locking pin of a butt stock that contacts said indexing slot is substantially perpendicular to a lengthwise axis of the locking pin.

6. A rapidly adjustable receiver extension, comprising:

a receiver extension including a plurality of inclined surfaces with an indexing slot disposed adjacent each one of said plurality of inclined surfaces, a vertical wall extends downward from a top of each one of said plurality of inclined surface to said indexing slot, wherein said receiver extension is capable of being retained in a butt stock.

7. The rapidly adjustable receiver extension of claim 6 wherein:

a threaded tap or a hole is formed in at least one of said plurality of inclined surfaces to receive a threaded fastener or an object.

8. The rapidly adjustable receiver extension of claim 7 wherein:

said threaded tap or said hole is formed adjacent to said indexing slot.

9. The rapidly adjustable receiver extension of claim 6 wherein:

said indexing slot is longer than a diameter of an indexing pin.

10. The rapidly adjustable receiver extension of claim 6 wherein:

an end surface of a locking pin of a butt stock that contacts said indexing slot is substantially perpendicular to a lengthwise axis of the locking pin.

* * * * *